US009057230B1

(12) United States Patent
Parsons

(10) Patent No.: US 9,057,230 B1
(45) Date of Patent: Jun. 16, 2015

(54) EXPANDABLE TUBULAR WITH INTEGRAL CENTRALIZERS

(71) Applicant: Ronald C. Parsons and Denise M. Parsons, trustees under the Ronald C. Parsons and Denise M., Houston, TX (US)

(72) Inventor: Ronald C. Parsons, Houston, TX (US)

(73) Assignee: Ronald C. Parsons, Houston, TX (US)

( * ) Notice: Subject to any disclaimer, the term of this patent is extended or adjusted under 35 U.S.C. 154(b) by 0 days.

(21) Appl. No.: 14/322,345

(22) Filed: Jul. 2, 2014

Related U.S. Application Data

(60) Provisional application No. 61/955,461, filed on Mar. 19, 2014.

(51) Int. Cl.
*E21B 43/10* (2006.01)
*E21B 19/24* (2006.01)

(52) U.S. Cl.
CPC ..... *E21B 19/24* (2013.01); *E21B 43/103* (2013.01); *E21B 43/108* (2013.01)

(58) Field of Classification Search
CPC ..... E21B 43/103; E21B 43/108
USPC ..... 166/206, 207
See application file for complete search history.

(56) References Cited

U.S. PATENT DOCUMENTS

| | | | |
|---|---|---|---|
| 4,471,843 | A | 9/1984 | Jones et al. |
| 4,646,828 | A | 3/1987 | Schwab, Jr. et al. |
| 4,739,273 | A | 4/1988 | Petersen et al. |
| 4,796,707 | A | 1/1989 | Halbardier et al. |
| 4,805,699 | A | 2/1989 | Halbardier |
| 4,828,023 | A | 5/1989 | Leggett |
| 4,869,325 | A | 9/1989 | Halbardier |
| 4,883,119 | A | 11/1989 | Leggett |
| 4,971,146 | A | 11/1990 | Terrell |
| RE33,614 | E | 6/1991 | Schwab, Jr. et al. |
| 5,097,905 | A | 3/1992 | Goodwin |
| 5,269,377 | A | 12/1993 | Martin |
| 5,297,579 | A | 3/1994 | McConnell et al. |
| 5,330,001 | A | 7/1994 | Baugh et al. |
| 5,346,016 | A | 9/1994 | Wilson et al. |
| 5,355,950 | A | 10/1994 | Zwart |
| 5,358,040 | A | 10/1994 | Kinley et al. |
| 5,379,838 | A | 1/1995 | Wilson et al. |
| 5,458,196 | A | 10/1995 | George et al. |
| 5,566,763 | A | 10/1996 | Williamson et al. |

(Continued)

FOREIGN PATENT DOCUMENTS

| | | |
|---|---|---|
| WO | 9925949 | 5/1999 |
| WO | 0202904 | 1/2002 |

*Primary Examiner* — Giovanna C Wright
(74) *Attorney, Agent, or Firm* — Timothy S. Westby; Porter Hedges, LLP.

(57) ABSTRACT

Herein disclosed is an apparatus comprising an expandable tubular; and at least one section of the expandable tubular having a larger outer diameter than the remainder of the expandable tubular, forming at least one complete centralizing ring or at least one partial centralizing ring. In an embodiment, at least one complete centralizing ring or at least one partial centralizing ring is configured to centralize the expandable tubular when the tubular is in use; and wherein at least one complete centralizing ring or at least one partial centralizing ring has the same diameter as the expandable tubular after the tubular is radially expanded. Also disclosed herein are method of using and method of making the apparatus.

16 Claims, 8 Drawing Sheets

(56) References Cited

U.S. PATENT DOCUMENTS

| | | | | |
|---|---|---|---|---|
| 5,613,559 | A | 3/1997 | Williamson et al. | |
| 5,758,723 | A | 6/1998 | Saucier et al. | |
| 5,765,640 | A | 6/1998 | Milne et al. | |
| 5,785,125 | A | 7/1998 | Royer | |
| 5,937,948 | A | 8/1999 | Robbins, III | |
| 5,979,550 | A | 11/1999 | Tessier | |
| 5,992,525 | A | 11/1999 | Williamson et al. | |
| 6,015,015 | A | 1/2000 | Luft et al. | |
| 6,092,593 | A | 7/2000 | Williamson et al. | |
| 6,405,761 | B1 * | 6/2002 | Shimizu et al. | 138/109 |
| 6,484,803 | B1 | 11/2002 | Gremillion | |
| 6,513,223 | B1 | 2/2003 | Angman et al. | |
| 6,585,052 | B2 | 7/2003 | Angman et al. | |
| 6,725,939 | B2 | 4/2004 | Richard | |
| 7,040,420 | B2 | 5/2006 | Vail, III | |
| 7,096,939 | B2 | 8/2006 | Kirk et al. | |
| 7,121,341 | B2 | 10/2006 | Vinegar et al. | |
| 7,121,349 | B2 | 10/2006 | Jennings | |
| 7,140,432 | B2 | 11/2006 | Gremillion | |
| 7,156,171 | B2 | 1/2007 | Gremillion | |
| 7,182,131 | B2 | 2/2007 | Gremillion | |
| 7,234,542 | B2 | 6/2007 | Vail, III | |
| 7,278,486 | B2 | 10/2007 | Alba et al. | |
| 7,281,578 | B2 | 10/2007 | Nakajima et al. | |
| 7,350,563 | B2 * | 4/2008 | Waddell et al. | 166/207 |
| 7,377,325 | B2 | 5/2008 | Trinder et al. | |
| 7,392,851 | B2 | 7/2008 | Brennan et al. | |
| 7,537,051 | B1 | 5/2009 | Hall et al. | |
| 7,537,053 | B1 | 5/2009 | Hall et al. | |
| 7,559,371 | B2 | 7/2009 | Lynde et al. | |
| 7,578,342 | B2 | 8/2009 | Brennan et al. | |
| 7,624,798 | B2 | 12/2009 | Presslie et al. | |
| 7,708,063 | B2 * | 5/2010 | Palmer | 166/241.1 |
| 7,775,272 | B2 | 8/2010 | Nelson et al. | |
| 7,841,394 | B2 | 11/2010 | McNeel et al. | |
| 7,857,063 | B2 | 12/2010 | Thornton | |
| 7,946,340 | B2 | 5/2011 | Surjaatmadja et al. | |
| 8,122,966 | B2 | 2/2012 | Kelley | |
| 8,196,670 | B2 | 6/2012 | Jenner | |
| 8,561,708 | B2 | 10/2013 | Johnson et al. | |
| 2002/0189808 | A1 | 12/2002 | Nguyen et al. | |
| 2005/0217865 | A1 * | 10/2005 | Ring | 166/382 |
| 2006/0067162 | A1 | 3/2006 | Blankinship et al. | |
| 2006/0243435 | A1 | 11/2006 | Faul | |
| 2006/0243456 | A1 | 11/2006 | Faul | |
| 2006/0262643 | A1 | 11/2006 | Blankinship et al. | |
| 2010/0170682 | A1 | 7/2010 | Brennan et al. | |
| 2010/0218956 | A1 | 9/2010 | Buytaert et al. | |
| 2010/0270081 | A1 | 10/2010 | Perry et al. | |
| 2011/0114336 | A1 | 5/2011 | Lehr et al. | |
| 2012/0024543 | A1 | 2/2012 | Head | |
| 2013/0126191 | A1 | 5/2013 | Brennan et al. | |
| 2013/0255935 | A1 * | 10/2013 | Rogers et al. | 166/241.1 |
| 2013/0255967 | A1 * | 10/2013 | Rogers et al. | 166/380 |
| 2013/0261974 | A1 | 10/2013 | Stewart et al. | |
| 2013/0333899 | A1 | 12/2013 | Xu et al. | |
| 2014/0027124 | A1 | 1/2014 | Cain et al. | |

* cited by examiner

EXPANDING THE CENTRALIZING RING ON EXPANDABLE TUBING AND CASING IF NECESSARY
INDUCTION HEAT RING
TUBING OR CASING

TUBING OR CASING
EXPANDING RING
EXPANDING RAM
HYDRAULIC RAM

SIZING CAP
EXPANDED RING
EXTENDED RAM

EXPANDABLE TUBULAR WITH INTEGRAL CENTRALIZERS

CROSS-REFERENCE TO RELATED APPLICATIONS

This application claims the benefit under 35 U.S.C. §119 (e) of U.S. Provisional Patent Application No. 61/955,461, filed Mar. 19, 2014, the disclosure of which is hereby incorporated herein by reference.

STATEMENT REGARDING FEDERALLY SPONSORED RESEARCH OR DEVELOPMENT

Not Applicable.

BACKGROUND

1. Field of the Invention

The present invention generally relates to expandable tubular with at least one centralizer. More particularly, the present invention describes an expandable tubular with at least one centralizer as an integral part of the tubular, its uses, and methods of making. Furthermore, this invention relates to a downhole tubular or downhole assembly, e.g., for use in an oil/gas well or a water well, and a method of completing a well.

2. Background of the Invention

In recent years, the use of expandable tubulars has become more common in the drilling and completion phases of well bore construction. In these phases, it is necessary to protect tubulars (e.g., casing, tubing, and/or seal bores) from scarring; and/or to protect sealing and anchoring devices; and/or to prevent the tubulars from being scarred while being run down hole. In some situations, it is desirable to preventing the tubulars from bending and/or egging when being handled.

In some cases, due to the limits of expansion of the expandable tubulars (e.g., casings and tubings), the outside/outer diameter (OD) of the tubular is as close as possible to the inside/inner diameter (ID) of the wellbore or casing. Rubber rings and other devices are either molded or attached to the expandable tubular to act as centralizers and seals after the tubular is expanded. The rubber rings may also serve to keep anchoring devices (anchors) attached to the tubular from scarring the casing and/or seal bores. During the expansion process, the anchoring devices (anchors) are pressed into the casing and hold the tubular in place; and the rubber rings or other devices would function as seals.

Because the OD of the tubing and seals and anchors is very close to the casing ID, if the tubing or seals touch the casing, the seals will compress below the tolerance of the anchors and damage the casing and/or seal bores. The anchors can also be dislodged causing more damage. In addition, the tubing and casing can be scarred causing it to split. When the tubulars are being handled, because the tubular material has little memory due to the high carbon content, it often eggs out of shape when it is picked up by a sling.

Accordingly, there is continuing need and interest to develop expandable tubulars/assemblies with improved centralizers.

SUMMARY

Herein disclosed is an apparatus comprising an expandable tubular; and at least one section of the expandable tubular having a larger outer diameter than the remainder of the expandable tubular, forming at least one complete centralizing ring or at least one partial centralizing ring. In an embodiment, at least one complete centralizing ring or at least one partial centralizing ring is configured to centralize the expandable tubular when the tubular is in use; and wherein at least one complete centralizing ring or at least one partial centralizing ring has the same diameter as the expandable tubular after the tubular is radially expanded.

In an embodiment, the apparatus further comprises at lease one seal to circumferentially surround the expandable tubular. In an embodiment, the apparatus further comprises at lease one anchor to circumferentially surround the expandable tubular.

In an embodiment, the tubular comprises a casing, a liner, a screen, or a production tubing. In an embodiment, the apparatus comprises a plurality of complete or partial centralizing rings longitudinally spaced along a length of the expandable tubular. In an embodiment, the plurality of partial centralizing rings are offset at different lengths of the expandable tubular. In an embodiment, the at least one partial centralizing ring comprises one or more segments.

In an embodiment, the outer diameter of the centralizing ring is larger than or equal to the outer diameter of an attachment on the tubular. In an embodiment, the outer diameter of the centralizing ring is larger than the outer diameter of the seal or anchor.

Further disclosed herein is a method of centralizing an expandable tubular within a borehole comprising providing at least one expandable tubular, wherein at least one section of the expandable tubular has a larger outer diameter than the remainder of the expandable tubular, forming at least one complete centralizing ring or at least one partial centralizing ring.

In an embodiment, the method further comprises placing the at least one expandable tubular in the borehole. In an embodiment, the method further comprises expanding the expandable tubular thereby causing expansion of the expandable tubular and the at least one complete centralizing ring or at least one partial centralizing ring, wherein the expanded tubular has the same diameter.

In an embodiment, expanding the expandable tubular comprises using a tubular expander either pushed down the tubular or pulled up the tubular. In an embodiment, at least one seal attached to the expandable tubular is compressed against a casing, causing a seal between the casing and the expanded tubular. In an embodiment, at least one anchor attached to the expandable tubular is embedded into a casing and the tubular is held in place.

Also disclosed herein is a method of making an expandable tubular, wherein at least one section of the expandable tubular has a larger outer diameter than the remainder of the expandable tubular, forming at least one complete centralizing ring or at least one partial centralizing ring. In an embodiment, the at least one complete centralizing ring or at least one partial centralizing ring is made using a hydraulic or mechanical fixture. In an embodiment, the method further comprises heating the expandable tubular before making the at least one complete centralizing ring or at least one partial centralizing ring. In an embodiment, the method further comprises heating the expandable tubular by induction before making the at least one complete centralizing ring or at least one partial centralizing ring.

The present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION

Overview.

To centralize an expandable tubular, at least a section of the tubular is enlarged to have a larger OD than the remainder of the expandable tubular, forming at least one complete centralizing ring or at least one partial centralizing ring (i.e., a complete ring of 360 degrees or a segment/segments thereof as a partial ring). When the tubular is being placed downhole, the centralizing rings (complete and/or partial) serve to centralize the tubular while minimizing scarring and protecting the seals and anchors. After the tubular is placed downhole and radially expanded, the centralizing ring will expand along with the remainder of the tubular and the expanded tubular will have the same diameter. In other words, these centralizing rings (complete and/or partial) function to centralize the expandable tubular and then disappear after the tubular is expanded.

As used herein, the term "tubular" refers to any tubular parts or components, especially related to the oil/gas/water well applications and downhole processes. Examples of such tubulars include a casing, a liner, a screen, or a production tubing.

As used herein, the term "seal" refers to any sealing component or sealing mechanism as known to one skilled in the art. For example, seals are made of rubber or rubber-like material, attached to a tubular. The seals are generally placed where necessary to perform a sealing function. In some cases, the seals have a thickness of from 1/16 inch to any required thickness. When a tubular is expanded, the seals are compressed, e.g., sealing the space between a casing and a tubing.

As used herein, the term "anchor" refers to any anchoring component/aggregate or anchoring mechanism as known to one skilled in the art, used to hold a device in place. There are various types of anchors. The anchors are generally made of a material much harder than the tubular (e.g., tubing or casing). The anchors are attached to the tubular by cement or welded onto the outside of the tubular. In some cases, when a tubing is expanded, the anchors attached to the tubing are embedded in the casing and tubing, holding the tubing in place.

Figure 1A:
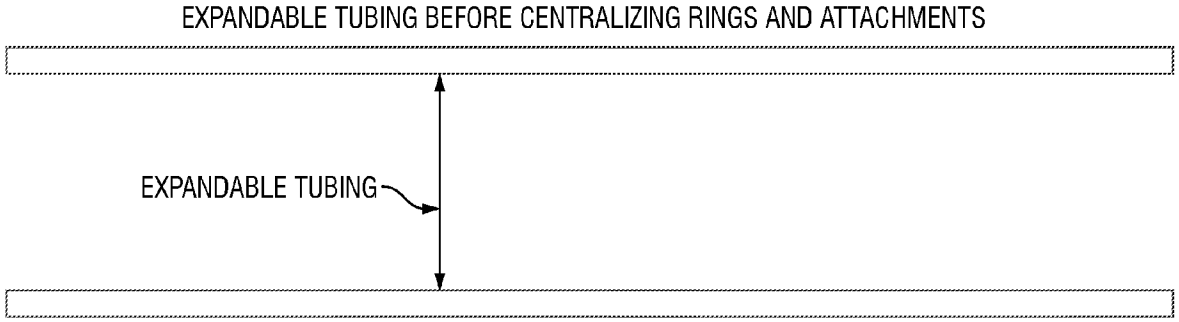
FIGS. 1A-B illustrates an expandable tubing before the centralizing rings are created (FIG. 1A) and an expandable tubing with a centralizing ring, a seal, and an anchor placed inside a casing (FIG. 1B), according an embodiment of this disclosure.
Figure 1B:
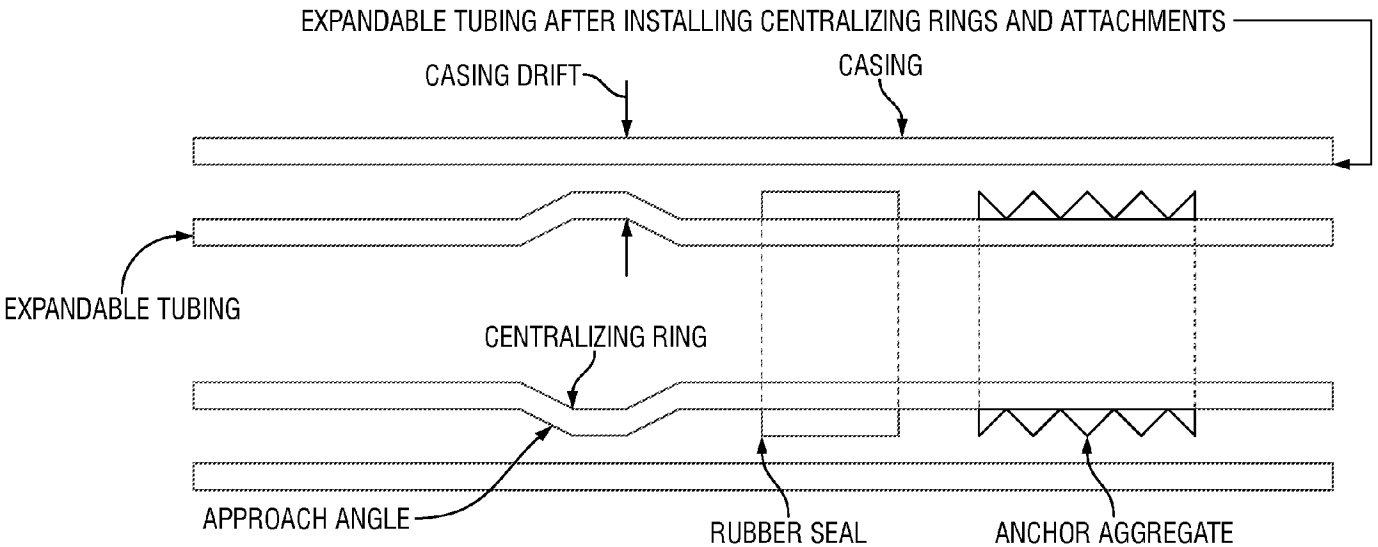

In an embodiment as illustrated by FIG. 1, FIG. 1A shows an expandable tubing. FIG. 1B shows an expandable tubing with a centralizing ring, a seal, and an anchor placed inside a casing. The OD of the centralizing ring is larger than the OD of the remainder of the tubing, the OD of the seal, and the OD of the anchor; but smaller than or equal to the casing drift. As such, the centralizing ring functions to centralize the tubing when it is being placed downhole and protects the seal and the anchor, the tubing and the casing from scarring and other potential damages.

Figure 2:
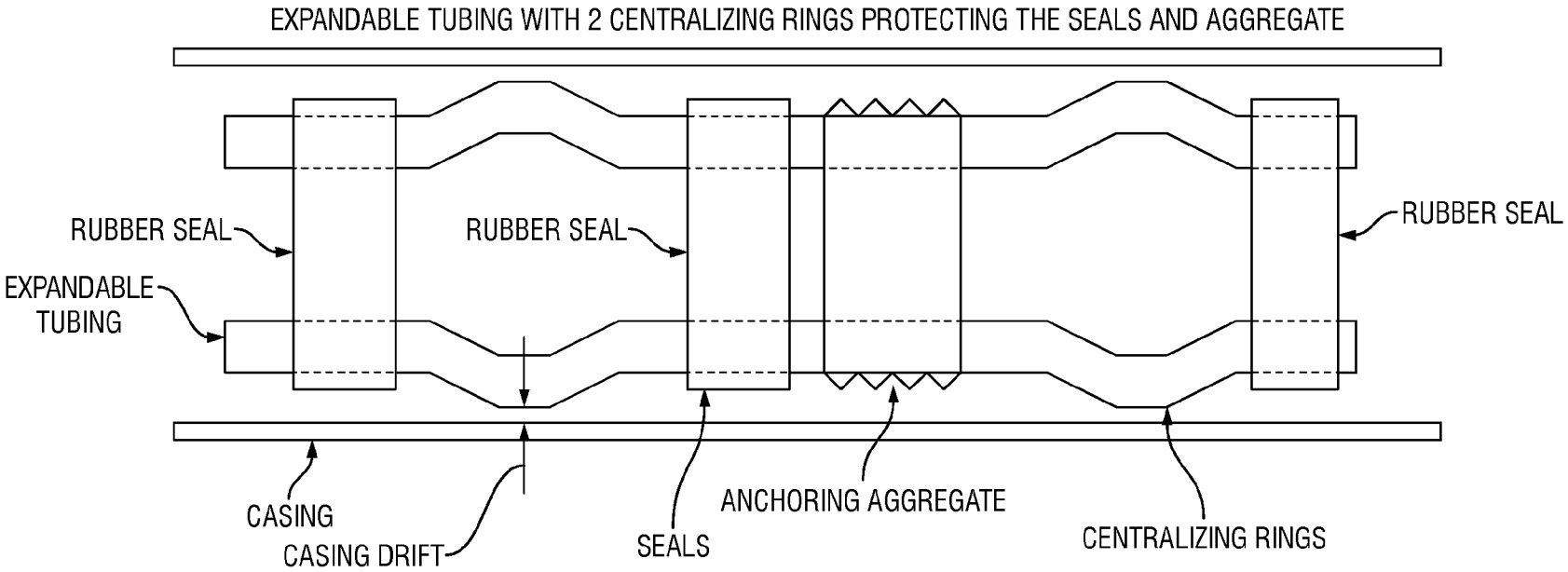
FIG. 2 illustrates an expandable tubular with two centralizing rings, seals, and an anchor placed inside a casing, according an embodiment of this disclosure.

In an embodiment as illustrated by FIG. 2, the expandable tubing has two centralizing rings and a plurality of seals and an anchor. The numbers of the centralizing rings, seals, and anchors shown are only illustrative and not limiting. Such numbers may be varied and determined according to specific needs and each particular application. In FIGS. 1 and 2, anchor is also called anchor aggregate or anchoring aggregate.

Figure 3A:
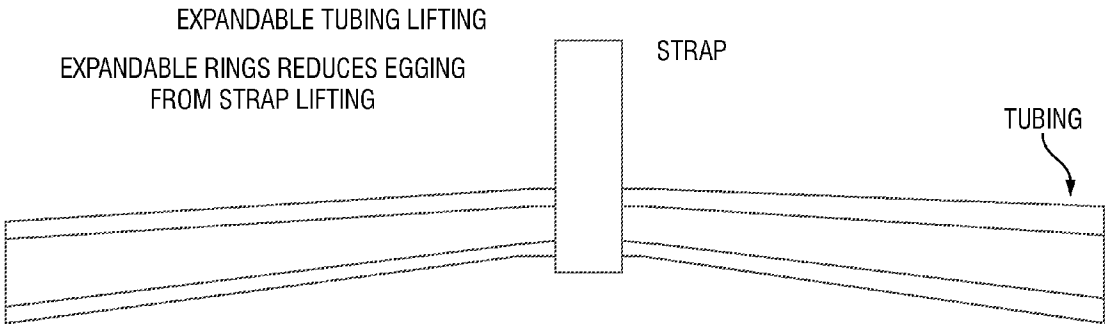
FIGS. 3A-C illustrate how the centralizing rings of this disclosure reduce egging of an expandable tubular during strap lifting, according an embodiment of this disclosure.
Figure 3B:
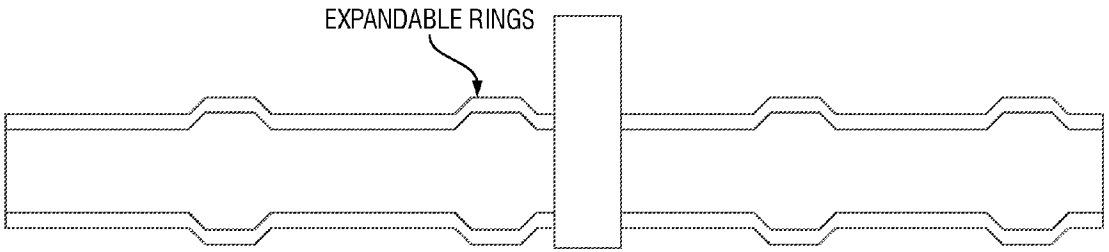
Figure 3C:
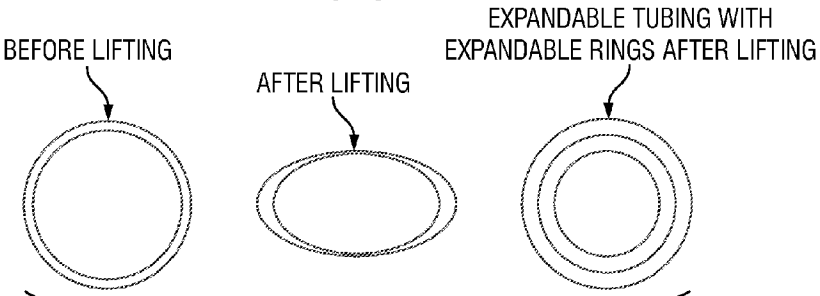

In an embodiment, FIG. 3 illustrates how the centralizing rings of this disclosure reduce egging of an expandable tubular during strap lifting. FIGS. 3A-B (side views) illustrate the difference between without (FIG. 3A) and with (FIG. 3B) the centralizing rings when a tubular is strap lifted. FIG. 3C (cross-section views) illustrate the difference between without and with the centralizing rings when a tubular is strap lifted.

Figure 4:
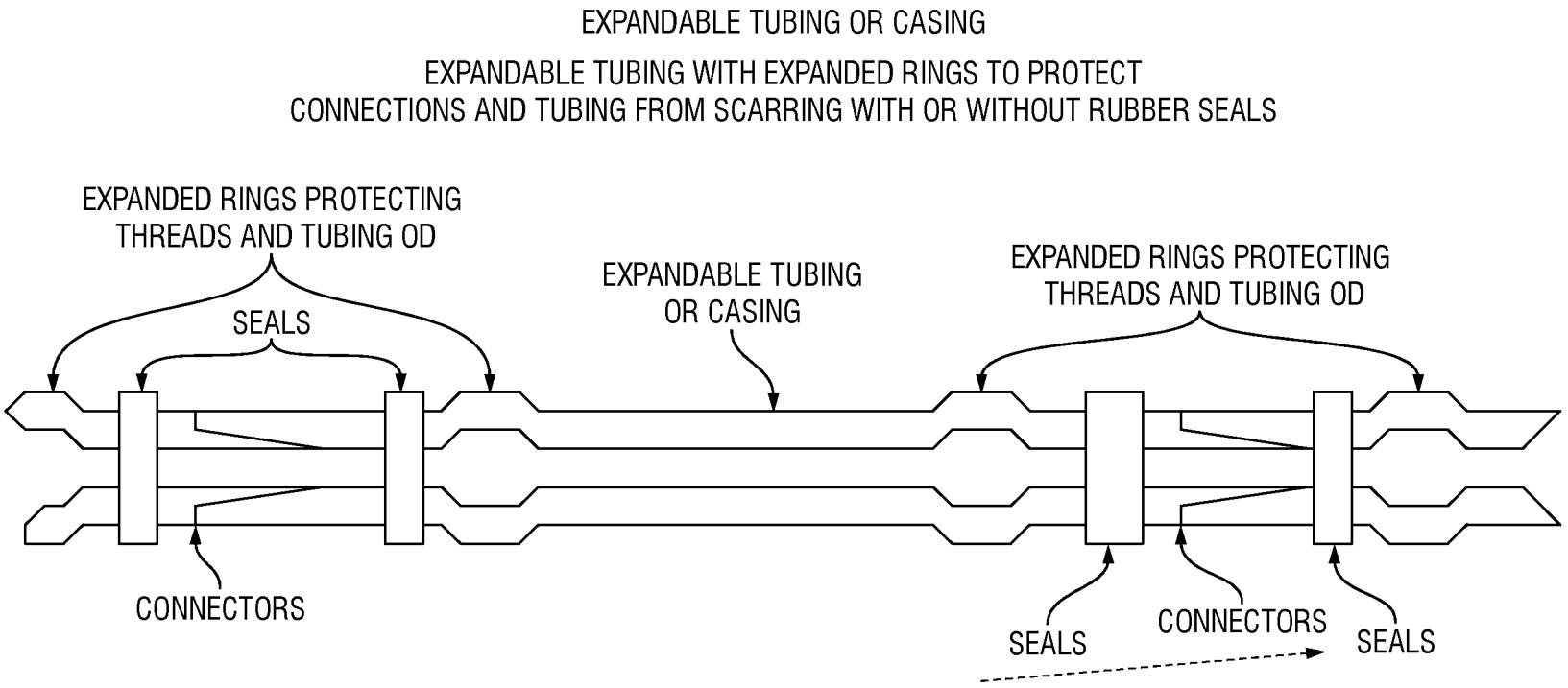
FIG. 4 illustrates how the centralizing rings of this disclosure protect connections and tubing or casing from scarring with or without seals, according an embodiment of this disclosure.

In an embodiment, FIG. 4 illustrates how the centralizing rings of this disclosure protect connections and tubing or casing from scarring with or without seals. The seals are made of rubber or similar material. As can be seen in FIG. 4, the OD of the centralizing rings is larger than the OD of the remainder of the tubular, the OD of the seals and/or anchors; thus the centralizing rings are able to protect threads and the tubular when the tubular is run downhole.

Figure 5A:
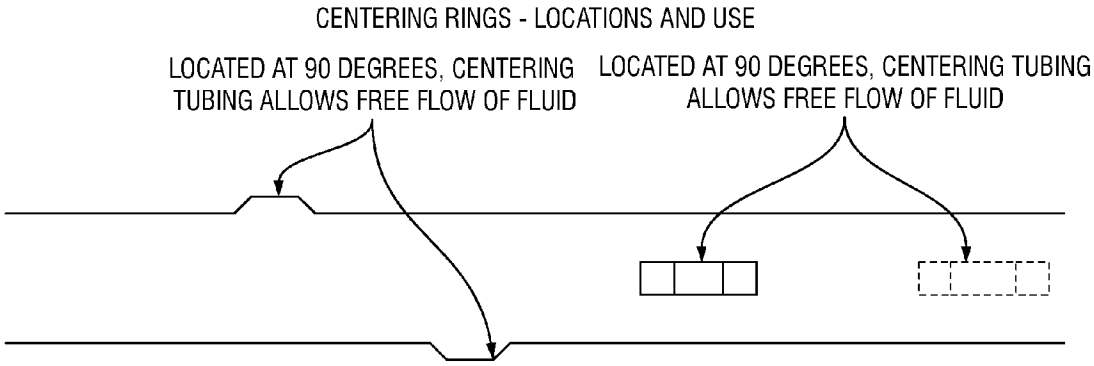
FIGS. 5A-C illustrate various embodiments of centralizing rings of 360 degrees or segments and their applications and benefits.
Figure 5B:
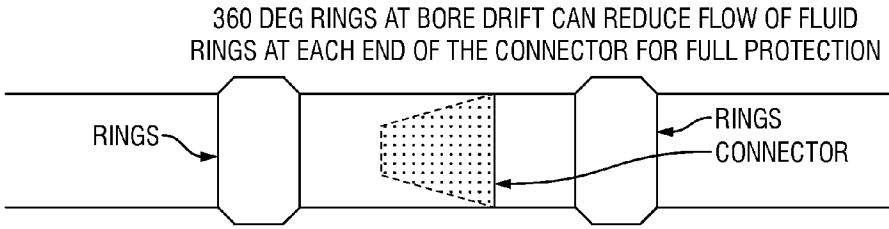
Figure 5C:
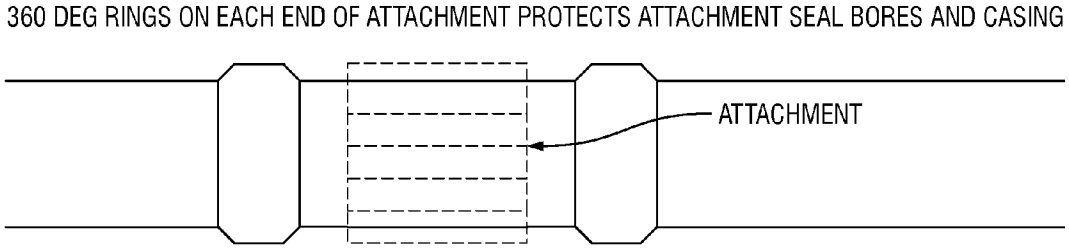

In an embodiment, to centralize an expandable tubular, specific locations of the tubular are selected to expand the tubular to form the centralizing rings (complete or partial). In various embodiments, as illustrated by FIG. 5, the centralizing rings can be 360 degrees (FIGS. 5B-C), or in segments (FIG. 5A) to reduce the potential rub surface. In some embodiments, the partial centralizing rings are offset at different lengths of the expandable tubular (see, e.g., FIG. 5A). This is not only advantageous in centralizing the tubular and reducing rub surface; but also in reducing resistance when the tubular is placed downhole because sometimes fluid fills the casing or wellbore and the (offset) partial rings allow the fluid to flow around them so that the tubular is placed with less resistance. For example, instead of a full 360-degree centralizing ring, a partial ring consisting of three segments of 45 degrees is used at the same location of the tubular. This partial ring allows more space for fluid to pass by and still centers the tubular when being placed downhole. In another embodiment, an expandable tubular comprises four partial centralizing rings (each of 90 degrees) separated by a length (e.g., of three feet), offset by 90 degrees from one another circumferentially. These partial rings provide more space for fluid to flow by, thus reducing resistance, and still center the tubular when it is being placed downhole (as illustrated by FIG. 5A). FIG. 5B illustrates that the 360-degree rings at bore draft could reduce flow of fluid; these rings at each end of a connector provide the connector full protection. FIG. 5C illustrates that the 360-degree rings on each end of a tubular attachment protect the attachment, seal bore, and casing.

In some cases, at least one seal or anchor or both are attached to the expandable tubular by circumferentially surrounding it. In some cases, the OD of the centralizing rings is expanded to a diameter larger than or equal to any attachment on the tubular. In some cases, the OD of the centralizing rings is expanded to a desired diameter greater than the seals and anchors. In some cases, the OD of the centralizing rings is expanded to the casing drift (e.g., for a production tubing). In some cases (e.g., expanding a casing), the OD of the centralizing rings is expanded to the well drift. In another embodiment, the centralizing rings and seals are used in a repair expandable. The repair expandable seal is used to repair or seal a hole in the casing. The seal is placed on each end of the leak or damage and will seal the hole or possible damage when expanded. There are attachments to hold the tubing in place when expanded. Sometimes, these attachments cause damage to the casing when expanded and cause a leak. The seals are used to seal the leak. In another embodiment, the seals also stop leakage between the expanded tubing and casing.

Figure 6:
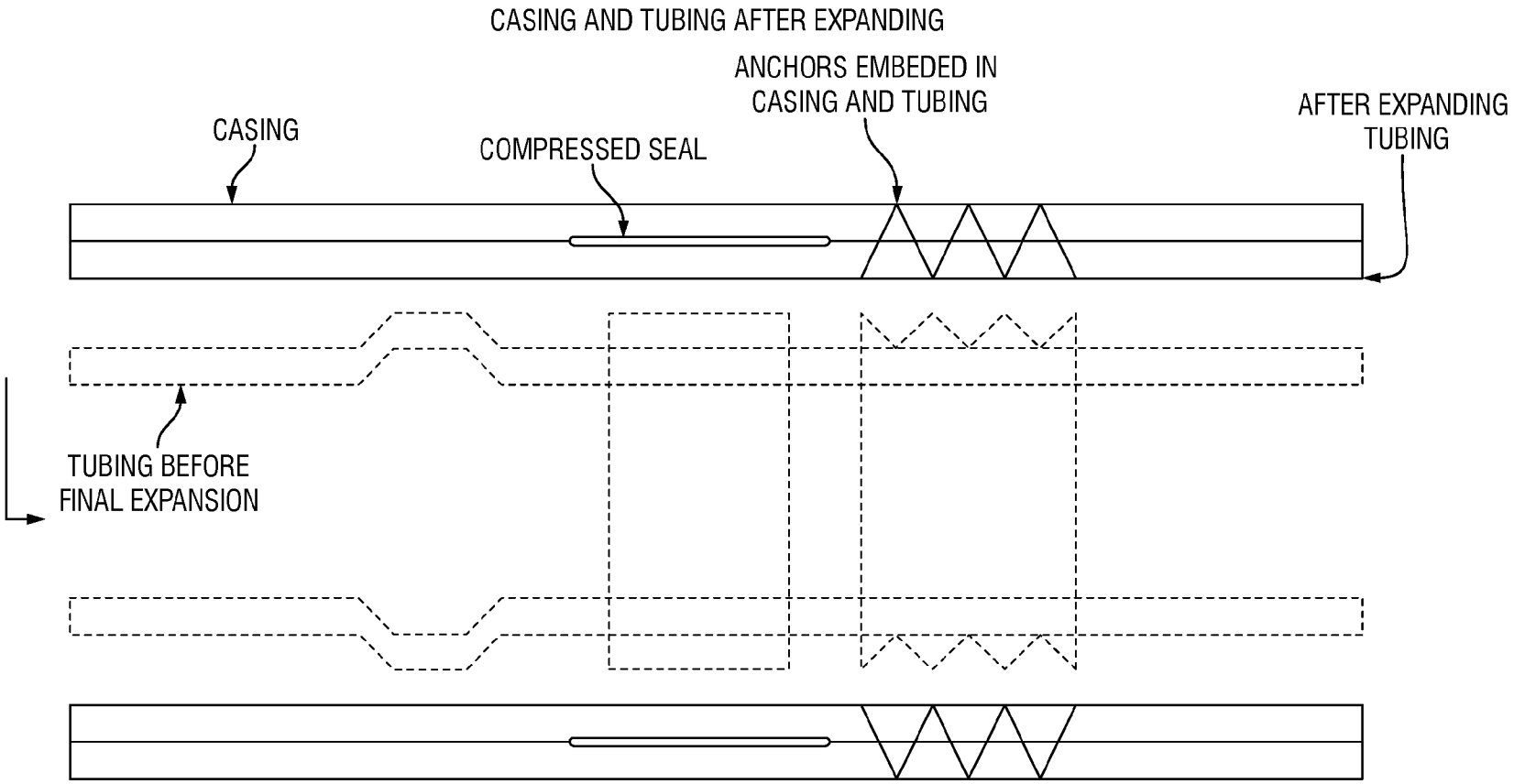
FIG. 6 illustrates a tubing after the tubing is expanded inside a casing, according an embodiment of this disclosure.

In an embodiment, as illustrated by FIG. 6, a tubing with a seal and an anchor and a centralizing ring (as shown by the dashed lines, before the tubing is expanded) is placed inside a casing. After the tubing is expanded, the tubing has the same diameter so the centralizing ring disappears and the seal is compressed against the casing and the anchor is embedded in the casing and tubing.

Figure 7A:
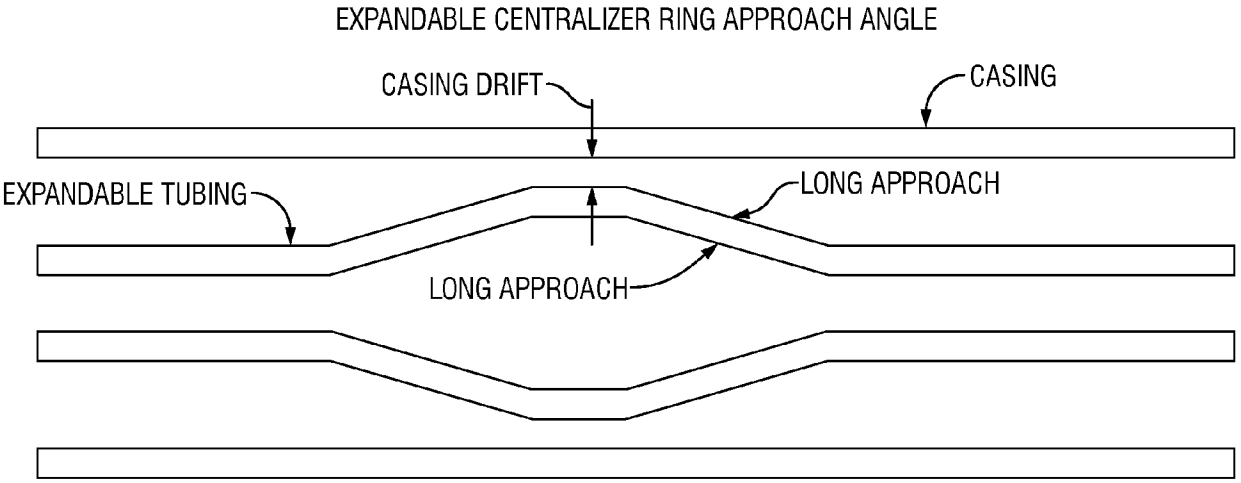
FIGS. 7A-B schematically illustrate long approach angle and short approach angle of a centralizing ring on an expandable tubular, according an embodiment of this disclosure.
Figure 7B:
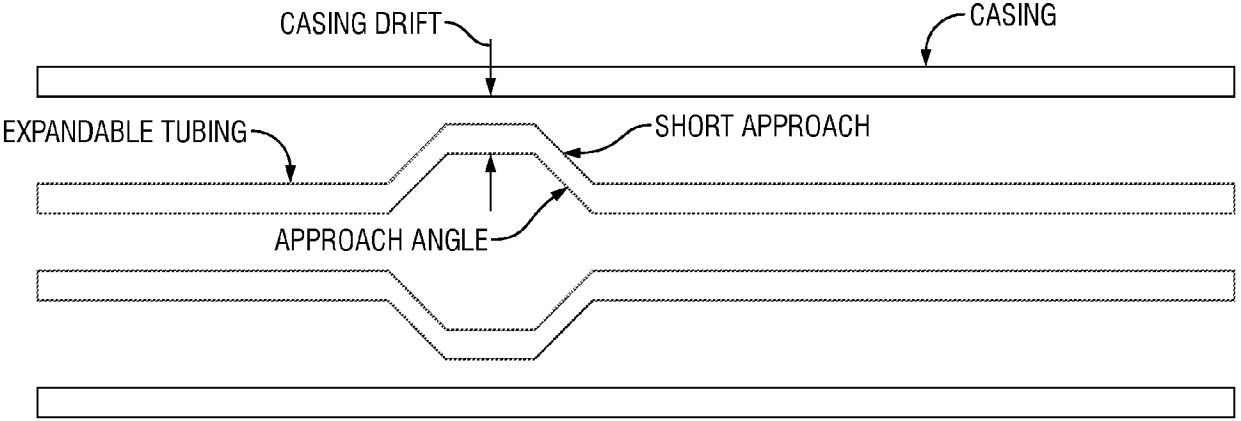

In some embodiments, the centralizing rings have long approach angles (FIG. 7A) or short approach angles (FIG. 7B) (before and after the selected drift), as illustrated by FIGS. 7A-B. The form depends on what is best for expansion. In some cases, when the rings are expanded along with the tubular, an approach is helpful for the expander since it takes tremendous pressure to expand the tubular (e.g., casing or tubing). An expander may look like a bowling pin attached to a cable. When it is pulled through the tubular, it expands it to the larger diameter of the pin. A gradual taper to the maximum inside diameter of the centralizing ring(s) would help to insure a somewhat constant expanding pressure on the expander, preventing a release of pressure that could cause the expander to have a sudden displacement, causing damage to the well derrick or tubing/casing or the expander itself.

If there is excessive wear on the outside diameter of the ring that could cause a split or leak, a rubber seal is applied before and/or after the centralizing ring to seal the leak. In other embodiments, expanded casing, tubing and the connections are protected from scarring and possible splitting using the centralizing rings and seals. In various embodiments, the centralizing rings are before or after the connections.

Method of Using Expandable Tubulars with Centralizing Rings.

In an embodiment, a method of centralizing an expandable tubular within a borehole comprises providing at least one expandable tubular, wherein at least one section of the expandable tubular has a larger outer diameter than the remainder of the expandable tubular, forming at least one complete centralizing ring or at least one partial centralizing ring. In an embodiment, an expandable tubular with the centralizing rings of this disclosure is placed in a borehole.

In a further embodiment, the tubular placed downhole is radially expanded, thereby causing expansion of the expandable tubular and the at least one complete centralizing ring or at least one partial centralizing ring, wherein the expanded tubular has the same diameter. In some cases, expanding the expandable tubular comprises using a tubular expander either pushed down the tubular or pulled up the tubular. For example, the tubing or casing is held in place and an expanding anvil is lowered to the bottom of the tubing or casing. The expanding anvil is expanded and pulled up through the tubing or casing expanding it. At that time, the centralizing rings become part of the tubing or casing with the same inside diameter and outside diameter. In some embodiments, seals attached to the tubing compress against the casing, causing a seal. In some embodiments, anchors attached to the tubing embed into the casing, causing the tubing to be held in place. In some cases, both seals and anchors are attached to the tubing and cause the tubing to be held in place after the tubing is (centrally placed downhole and) expanded.

Method of Making Expandable Tubulars with Centralizing Rings.

Figures 8A, 8B, 8C:
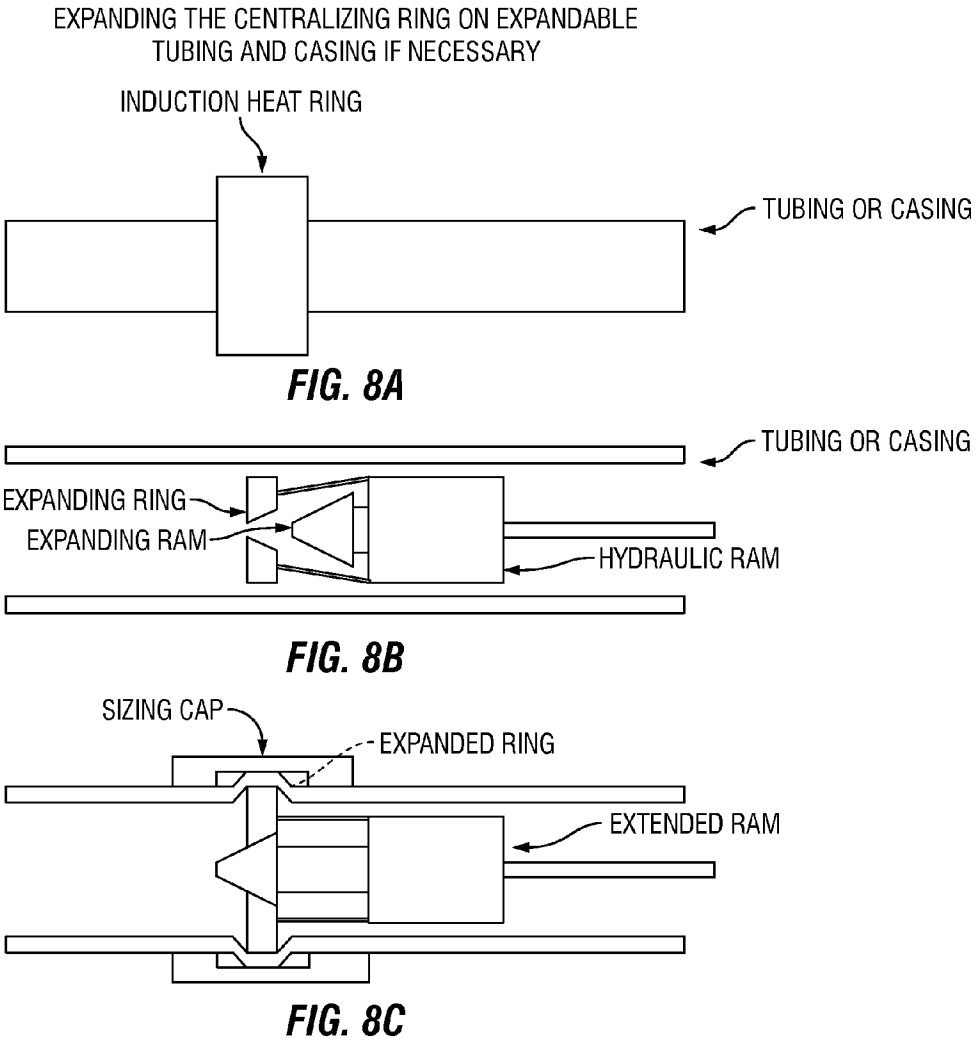
FIGS. 8A-C illustrates how a centralizing ring of this disclosure is made for an expandable tubular, according an embodiment of this disclosure.

In an embodiment, a centralizing ring of this disclosure is made using hydraulic or mechanical fixtures. For example, as shown in FIG. 8B, an expanding anvil is placed in an expandable tubular (tubing or casing), at a first desired position. As illustrated in FIG. 8C, a sizing block (or sizing cap or sizing clamp) is attached to the outside of the tubular to insure the proper diameter of a centralizing ring is created. The anvil is then mechanically expanded until the sizing clamp stops the expansion. The anvil (or ram) is moved to another location and the process is repeated to create a second centralizing ring as needed/desired. In some cases, the expandable tubular is heated before the centralizing rings are created. In some cases, induction heating is used to heat the tubular before the centralizing rings are made (see, e.g., FIG. 8A).

Advantages of Using Centralizing Rings.

In an embodiment, the centralizing rings are able to center an expandable tubular when it is placed downhole, e.g., preventing the casing from scarring the tubing. (If the tubing is scarred, it could split when the tubing is expanded.) The centralizing rings are also able to prevent any attachment on the tubing from scarring the well bore, the seal bore, and/or other equipment in the well. In various embodiments, the use of the centralizing rings of this disclosure is able to protect seals and anchors and other devices mounted outside (e.g., circumferentially) the expandable tubular.

Since the rubber seals are used for sealing only (not both centralizing and sealing), the seals are able to sustain larger tolerances, reducing cost and production time of the tubular assembly/apparatus. In some cases, the rubber seals are added/applied by hand, which reduces freight cost and further speeds up production time. If the seal is not needed, the integral centralizer(s) will improve lead time and reduce costs significantly because most of the centralizers currently used are circumferential attachments or seals on the tubular whether or not a sealing function is actually needed.

Similarly, tolerance of the anchor(s) is increased, reducing production time and cost. Centralizing the tubular when it is being placed downhole reduces and eliminates scarring on the tubular. For example, casing, seal bores, and other equipment in the borehole are not scarred by the anchors. Connections used in tubing and expanded casing are also protected from scarring. In other embodiments, when a tubular is handled (e.g., lifted or picked up), egging is reduced and thus rejections of the tubular are also reduced.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. An apparatus comprising at least one single expandable tubular comprising at least one partial centralizing ring formed in a middle section of the tubular having a pre-expansion outer diameter greater than a pre-expansion outer diameter of the remainder of the expandable tubular, wherein the tubular comprises at least one complete centralizing ring and at least one additional partial centralizing ring, wherein said at least one complete centralizing ring or at least one partial centralizing ring has said pre-expansion outer diameter greater than the pre-expansion outer diameter of the remainder of the expandable tubular and smaller than or equal to casing drift or well drift;

wherein, upon radial expansion, the at least one complete centralizing ring or the at least one partial centralizing ring has an expanded outer diameter substantially equal to an expanded outer diameter of the remainder of the expandable tubular, and wherein the expanded outer diameter is greater than the pre-expansion outer diameter of the remainder of the expandable tubular.

2. The apparatus of claim 1, wherein at least one complete centralizing ring or at least one partial centralizing ring is configured to centralize said expandable tubular when the tubular is in use.

3. The apparatus of claim 1 further comprising at lease one seal to circumferentially surround the expandable tubular, wherein the at least one seal is located on the remainder of the expandable tubular.

4. The apparatus of claim 1 further comprising at lease one anchor to circumferentially surround the expandable tubular, wherein the at least one anchor is located on the remainder of the expandable tubular.

5. The apparatus of claim 1, wherein said tubular comprises a casing, a liner, a screen, or a production tubing.

6. The apparatus of claim 1 comprising a plurality of complete or partial centralizing rings longitudinally spaced along a length of the expandable tubular.

7. The apparatus of claim 6, wherein the plurality of partial centralizing rings are offset at different lengths of the expandable tubular.

8. The apparatus of claim 1, wherein said at least one partial centralizing ring comprises one or more segments.

9. The apparatus of claim 1, wherein the pre-expansion outer diameter of the at least one centralizing ring or the at least one partial centralizing ring is larger than or equal to a pre-expansion outer diameter of an attachment on the remainder of the expandable tubular.

10. The apparatus of claim 1, wherein the pre-expansion outer diameter of the at least one centralizing ring or the at least one partial centralizing ring is larger than a pre-expansion outer diameter of a seal or anchor on the remainder of the expandable tubular.

11. A method of centralizing an expandable tubular within a borehole comprising:

providing at least one single expandable tubular before said tubular is placed in a borehole, wherein at least one middle section is formed in the at least one single expandable tubular which has an outer diameter greater than the outer diameter of the remainder of the expandable tubular, forming at least one complete centralizing ring or at least one partial centralizing ring, wherein the expandable tubular is configured such that, upon radial expansion, the at least one complete centralizing ring or the at least one partial centralizing ring has an expanded outer diameter substantially equal to an expanded outer diameter of the remainder of the expandable tubular, and wherein the expanded outer diameter is greater than the outer diameter of the remainder of the expandable tubular prior to expansion thereof.

12. The method of claim 11 further comprising placing the at least one expandable tubular in the borehole.

13. The method of claim 11 further comprising expanding the expandable tubular thereby causing expansion of the remainder of the expandable tubular and the at least one complete centralizing ring or at least one partial centralizing ring.

14. The method of claim 13, wherein expanding the expandable tubular comprises using a tubular expander either pushed down the expandable tubular or pulled up the expandable tubular.

15. The method of claim 13, wherein at least one seal attached to the expandable tubular is compressed against a casing, causing a seal between the casing and the expanded tubular.

16. The method of claim 13, wherein at least one anchor attached to the expandable tubular is embedded into a casing and said expandable tubular is held in place.

* * * * *

UNITED STATES PATENT AND TRADEMARK OFFICE

CERTIFICATE OF CORRECTION

PATENT NO. : 9,057,230 B1
APPLICATION NO. : 14/322345
DATED : June 16, 2015
INVENTOR(S) : Ronald C. Parsons It is certified that error appears in the above-identified patent and that said Letters Patent is hereby corrected as shown below:

In the Claims

Claim 3, column 7, line 37; and Claim 4, column 7, line 41, each occurrence, lease should be changed to --least--.

Signed and Sealed this
Twelfth Day of April, 2016

Michelle K. Lee

Michelle K. Lee
*Director of the United States Patent and Trademark Office*